United States Patent [19]

Stefano

[11] Patent Number: 4,968,565

[45] Date of Patent: Nov. 6, 1990

[54] PERSONALIZED ORNAMENT FOR CHRISTMAS TREE

[76] Inventor: Patrick L. Stefano, 12421 York Rd., North Royalton, Ohio 44133

[21] Appl. No.: 315,498

[22] Filed: Feb. 27, 1989

[51] Int. Cl.[5] ..... A47G 33/08

[52] U.S. Cl. ..... 428/542.4; 428/13; 428/28; 428/34.1

[58] Field of Search ..... 428/34.4, 7, 11, 13, 428/34.1, 3, 28, 542.4; 206/806; 446/73, 74, 75; 40/660

[56] References Cited

U.S. PATENT DOCUMENTS

| | | | |
|---|---|---|---|
| 475,400 | 5/1892 | Houghton et al. | 428/34.1 X |
| 2,506,800 | 5/1950 | MacLennan | 428/28 X |
| 2,726,320 | 12/1955 | Damiano | 428/7 X |
| 3,014,299 | 12/1961 | Voloshin | 428/11 |
| 3,696,914 | 10/1972 | McPhail | 206/303 |
| 4,019,269 | 4/1977 | Vix | 40/660 |
| 4,173,667 | 11/1979 | Rusch | 428/34.1 X |
| 4,224,364 | 9/1980 | Hunt | 428/11 |
| 4,300,887 | 11/1981 | Riemer | 428/11 X |
| 4,358,487 | 11/1982 | Walker | 428/11 |
| 4,452,836 | 6/1984 | Daniel, Jr. | 428/11 |
| 4,454,204 | 6/1984 | Posey | 428/11 X |
| 4,592,936 | 6/1986 | Ferguson | 428/34.1 X |

FOREIGN PATENT DOCUMENTS

| | | | |
|---|---|---|---|
| 1191427 | 4/1959 | France | 428/13 |

*Primary Examiner*—Henry F. Epstein
*Attorney, Agent, or Firm*—Donald A. Bergquist

[57] ABSTRACT

An ornament, to be hung on a Christmas tree or elsewhere, is adapted to receive within a transparent tubular portion thereof a personalizing element to be viewed through the transparent portion. Primarily intended for the insertion of photographs, drawings, personal messages, or other indicia on paper or other weblike material, the ornament of this invention could also be used to display a three-dimensional object or objects, such as a toy or other memorabilia having spcial meaning to the user. In one embodiment, one end cap on the tubular portion is adapted to receive a small lamp, such as a miniature Christmas tree light.

11 Claims, 2 Drawing Sheets

PERSONALIZED ORNAMENT FOR CHRISTMAS TREE

INTRODUCTION

An ornament, to be hung on a Christmas tree or elsewhere, is adapted to receive within a transparent tubular portion thereof a personalizing element to be viewed through the transparent portion. Primarily intended for the insertion of photographs, drawings, personal messages, or other indicia on paper or other weblike material, the ornament of this invention could also be used to display a three-dimensional object or objects, such as a toy or other memorabilia having special meaning to the user. In one embodiment, one end cap on the tubular portion is adapted to receive a small lamp, such as a miniature Christmas tree light.

BACKGROUND

A photograph can bring sweet nostalgic memories, as can other rememberances such as Baby's favorite rattle, the lace handkerchief from Mother's wedding, or even Dad's old watch. These memorabilia are too often packed away in a trunk or a drawer and not seen for years at a time. Similarly, small pieces of children's artwork are often lost in storage.

Each year, many people prepare for Christmas by putting up in their homes evergreen trees decorated with lights and ornaments. These ornaments are generally brought out of storage every year; some of them are unique and bring to mind tender moments from the past.

The present invention combines the personal memorabilia each of us accumulates during our lifetime—memorabilia that relate uniquely to the individual or the individual's family unit—with the annual rediscovery of memory-kindling mementos that comes with the preparations for the Christmas season. In using the invention, the personal memorabilia are inserted within a tubular ornament of the invention that preserves and protects them while providing for their display. Thus, in addition to being decorative and highly personalized, the ornament of this invention is useful and can be adapted to protect and display a wide range of memorabilia, not the least of which is a photograph.

SUMMARY OF THE INVENTION

The present invention is an ornament that comprises a transparent cylindrical tube that is closed by an end cap at each end, one of which end caps is removable for the insertion into the volume within the tube of personalizing memorabilia of some sort. One end cap may be adapted by means of a hook or a loop for hanging the ornament. One end cap, preferably the one adapted for hanging, may have a hole for the insertion of a lamp within the ornament. The use of a lamp creates a particularly attractive effect when the memorabilia is a photograph or indicia on translucent paper (or other weblike material) that is curled to line the inside of the tube, wherein the light from the lamp within illuminates the indicia from the rear.

Thus it is an object of this invention to provide an ornament of a tubular shape adapted to be highly personalized by the insertion within it of a photograph or other indicia on a weblike material that may be coiled to line the transparent tube for display thereof.

It is also an object of this invention to create an ornament of a tubular shape adapted to be highly personalized by the insertion within it of memorabilia for display thereof.

It is also an object of this invention to create an ornament according to the previous objects, but adapted for hanging.

It is also an object of this invention to create an ornament according to previous objects, but adapted for standing on a flat supporting surface.

It is also an object of this invention to create an ornament according to previous objects, but adapted for receiving a small electric lamp within it.

These and other objects of this invention will become abundantly clear from the ensuing detailed discussion.

DETAILED DESCRIPTION OF THE INVENTION

This invention will best be understood by referring to the attached drawings wherein the same parts are identified by the same reference number throughout.

Figure 1:
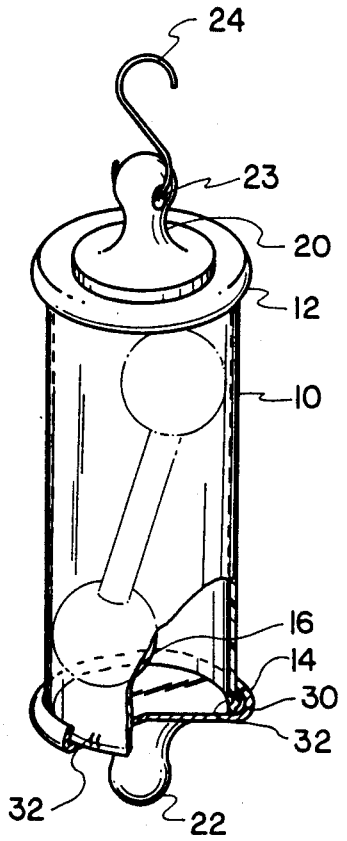
FIG. 1 is an isometric view of an ornament of this invention in which a baby's rattle is displayed.

FIG. 1 illustrates one embodiment of the invention, which comprises a transparent tube 10 having open ends and a first removable end cap 12 and a second removable end cap 14, these end caps closing the open ends of the tube 10 thereby to enclose an internal volume into which one or more articles of memorabilia 16 may be placed for protection during display or storage. The end caps 12 and 14 may be additionally fitted with decorative finials 20 and 22, one of which may be adapted, as by means of a hole therein 23, to be hung by either a hook 24 or a loop.

In this figure, one end cap 14 is shown attached by means of an interference fit between a concavity 30 within the end cap 14 and dimples or projections 32 from the peripheral wall of the tube 10. Although this attachment method represents only one possible means for joining end caps to the tube, it is the best mode.

Figures 2, 4:
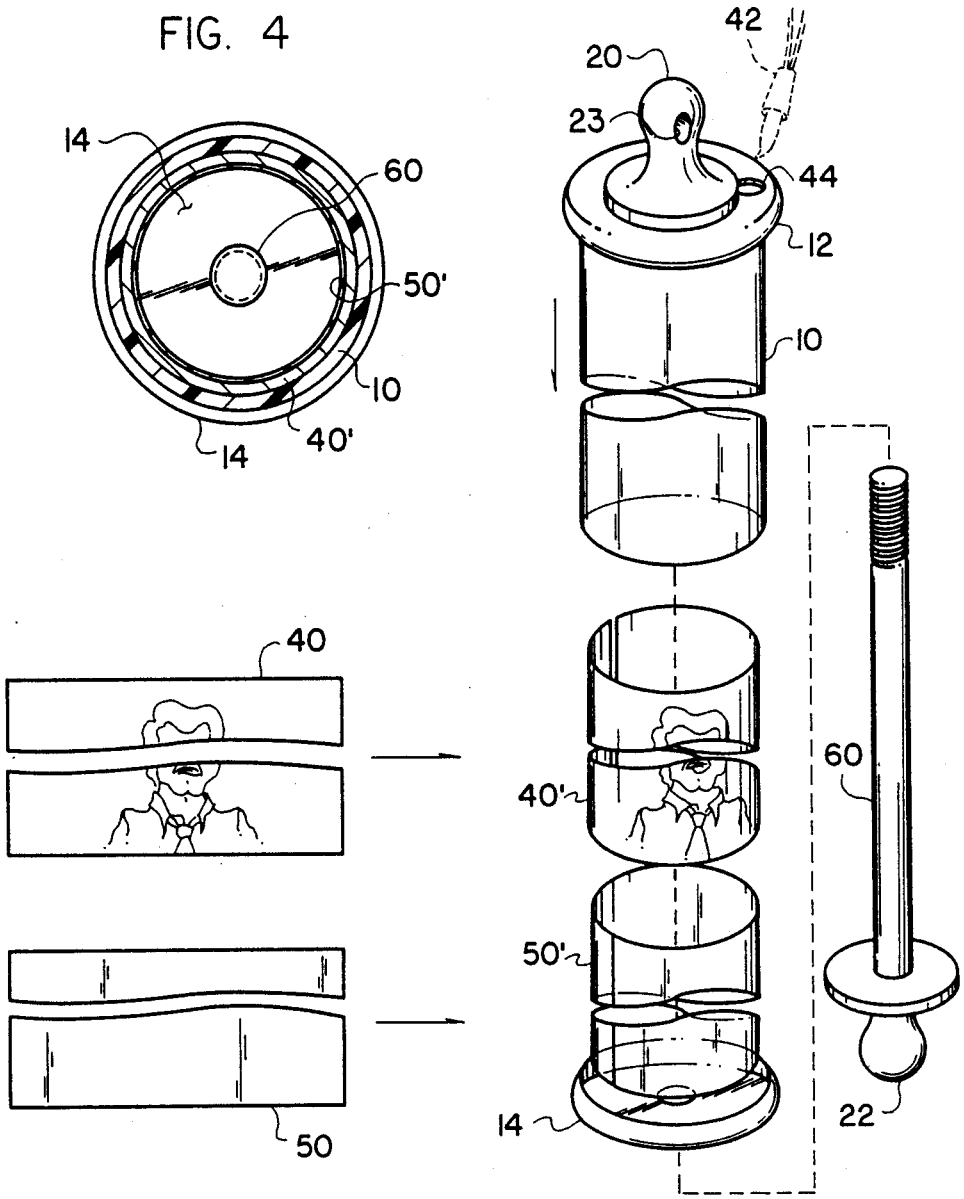
FIG. 2 is an exploded view of an ornament of this invention in which a photograph or other indicia on paper is displayed.
FIG. 4 shows a transverse cross-sectional view of the invention as it is used to display a photograph.

FIG. 2 illustrates in an exploded view how a photograph might be displayed in the present invention and how a lamp might be inserted for illuminating the photograph from behind. The invention is shown to comprise a transparent tube 10 having open ends and a first removable end cap 12 and a second removable end cap 14, these end caps closing the open ends of the tube 10 thereby to enclose an internal volume into which one or more articles of memorabilia may be placed for protection during display or storage.

In this case, the memorabilia is a photograph 40 or other web-like material bearing indicia. The photograph 40 is rolled 40' to fit within the tube 10 while at least one end cap is removed therefrom. It may be desirable to further support the photograph 40 by inserting within the rolled photograph 40' a sheet of transparent or translucent support material 50 that has been rolled 50' to fit within the rolled photograph; in practice, this is not usually necessary, however. The end cap is then replaced to contain and protect the memorabilia. A miniature lamp 42, of a type commonly used on Christmas trees may be inserted through a hole 44 in end cap 12.

In the embodiment of FIG. 2, an alternative means of attaching the end caps 12 and 14 to the tube 10 is shown. An elongate rodlike element 60 threadably engages the finials 20 and 22, thereby clamping together the end caps and the tube. This embodiment is most useful in displaying photographs or other web-like material bearing indicia, in which case the memorabilia surrounds the rodlike element 60 that might otherwise be considered unsightly.

Figure 3:
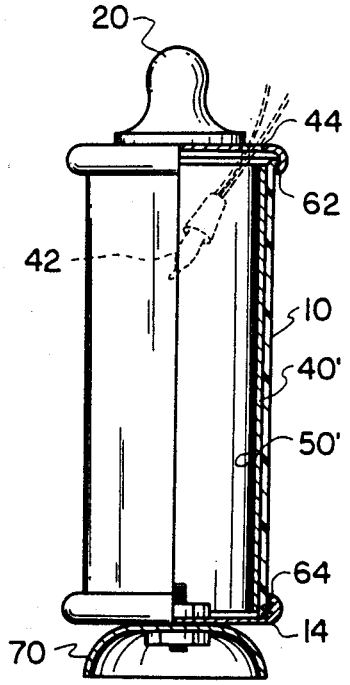
FIG. 3 shows alternative constructions of an ornament of this invention in partial cutaway views.

Other means for attachment of the end caps 12 and 14 to the tube 10 are illustrated in FIG. 3. The end cap 12 attaches by means of an interference fit between a concavity around the inside rim of the end cap, said concavity being engaged by a flared end portion 62 of the tube. These elements may easily be snapped together or snapped apart. The end cap 14 attaches by means of a threaded joint 64 formed between the tube 10 and the end cap 14. The end cap 14 may be removed and reattached. A decorative finial 20, if desired, may be permanently or removably attached to the end cap 12 by any conventional means, of which many are available.

An alternate form of support for the invention is also shown in FIG. 3, wherein a supporting base 70 is attached to one end cap 14 for keeping the ornament of this invention in an upright position on a horizontal surface.

A cross-sectional view of the ornament of FIG. 2 is shown in FIG. 4, showing the relationship between the rolled photograph 40', the rolled support 50', and the tube 10.

Having thus described his invention, including totally functional specific examples thereof, applicant desires to include within the scope of his invention those improvements that would be immediately obvious to one skilled in the art, some, but not all of which have been referred to herein. Applicant desires the breadth of his invention to be limited only by the scope of the claims appended hereto.

I claim:

1. A decorative and functional ornament comprising a transparent hollow tubular body having a longitudinal axis and having a first and a second open end, said first open end bearing a first closure that may be removable, said second open end bearing a second closure that is removable, said ornament adapted to receive within the body thereof personalizing memorabilia, thereby providing for the protecting, displaying, and storing of said memorabilia, and wherein one of said closures attaches to said tubular body by means of an interference fit between at least one recess in said closure and at least one projection from the periphery of said body.

2. The ornament of claim 1 wherein one of said closures is adapted for hanging the ornament by means of a hook.

3. The ornament of claim 1 wherein one of said closures is adapted for hanging the ornament by means of a loop.

4. The ornament of claim 1 wherein one of said closures is adapted for supporting the ornament in an upright position on a horizontal surface.

5. The ornament of claim 1 wherein said projection is created by flaring an open end of said body.

6. The ornament of claim 1 wherein said memorabilia is a weblike material bearing indicia, which material is curled to line the inside surface of said tubular body.

7. The ornament of claim 6 wherein said indicia comprises a photographic image.

8. The ornament according to claims 6 or 7 wherein said first and second closures are threadably joined by a threaded connector coaxial with said longitudinal axis of said tubular body.

9. The ornament according to claims 6 or 7 wherein said weblike material receives support from a translucent liner wherein said weblike material is supported in an annular space formed between said liner and said tubular body.

10. The ornament as in claims 1, 6, or 7 wherein one of said closures is adapted by means of a hole penetrating therethrough to receive a lamp for illuminating the inside of said ornament.

11. The ornament of claim 10 wherein said first and second closures are threadably joined by a threaded connector coaxial with said longitudinal axis of said tubular body.

* * * * *